US006082034A

United States Patent [19]

Musmanno

[11] Patent Number: 6,082,034

[45] Date of Patent: Jul. 4, 2000

[54] APPARATUS FOR SUPPORTING THE ARM WHEN EXTENDED FROM THE BODY

[76] Inventor: Brad A. Musmanno, 92 Maple Pkwy., Sparta, N.J. 07871

[21] Appl. No.: 09/152,148

[22] Filed: Sep. 11, 1998

[51] Int. Cl.[7] ..... F41A 27/30

[52] U.S. Cl. ..... 42/94

[58] Field of Search ..... 42/94; 89/37.04; 248/118

[56] References Cited

U.S. PATENT DOCUMENTS

| | | | |
|---|---|---|---|
| 167,169 | 8/1875 | Hare | 42/94 |
| 759,593 | 5/1904 | Cover | 224/5 |
| 1,406,827 | 2/1922 | Dumas . | |
| 3,191,826 | 6/1965 | Adams | 224/5 |
| 3,390,477 | 7/1968 | Galbraith | 42/94 |
| 3,784,068 | 1/1974 | Pistelli | 224/5 |
| 4,674,472 | 6/1987 | Reis | 124/89 |
| 4,844,390 | 7/1989 | Duke | 248/118 |
| 5,272,955 | 12/1993 | Bond et al. | 89/37.04 |
| 5,351,867 | 10/1994 | Vest | 224/224 |
| 5,413,552 | 5/1995 | Iwuala | 602/4 |
| 5,481,817 | 1/1996 | Parker | 248/286 |
| 5,487,374 | 1/1996 | Herminath | 124/86 |
| 5,509,400 | 4/1996 | Chalin | 124/86 |
| 5,528,846 | 6/1996 | Baggett | 42/94 |
| 5,738,256 | 4/1998 | Goff et al. | 224/185 |
| 5,784,820 | 7/1998 | Wood | 42/94 |

*Primary Examiner*—Charles T. Jordan
*Assistant Examiner*—Denise J Buckley
*Attorney, Agent, or Firm*—LaMorte & Associates

[57] ABSTRACT

A support device for supporting a person's arm when the arm is extended. The device can also be used to support an optical instrument such as a camera. The support device has a base structure adapted to be worn about a person's waist, proximate the hip. A support shaft extends from the base structure. The support shaft has a predetermined extended length between a first end and a second end. The support shaft contains a piston between its two ends. The presence of the piston enables said support shaft to be contracted to a contracted length that is less than its normal length. This enables a person to move his/her arm up and down while still being supported. The support shaft connects to the base structure with a ball and socket joint. Consequently, the support shaft is also free to move back and forth with that person's arm.

15 Claims, 5 Drawing Sheets

APPARATUS FOR SUPPORTING THE ARM WHEN EXTENDED FROM THE BODY

BACKGROUND OF THE INVENTION

1. Field of the Invention

The present invention relates to devices that are used to support the arm when the arm is fully or partially extended outwardly away from the body. More specifically, the present invention relates to devices that attach to the body and provide a rigid support upon which an extended arm may rest.

2. Description of the Prior Art

There are many activities that require the arms of the body to be extended away from the body for prolonged periods of time. For example, when a person is hunting or target shooting, that person must hold the weight of a gun or a bow for extended periods of time while a target is located, aimed at and fired upon. As the arm is used to support an object, such as a gun, a bow, or a camera, the arm is not static. Rather, the arm moves as it struggles to support its own weight and the weight of the object being held. As fatigue in the muscles of the arm increases, the degree of movement in the arm also increases.

In many activities, small movements in the arms are insignificant. However, when a person is aiming a gun, bow or camera at a target in the far distance, even small movements in the arm can cause the target to be missed. It is for this reason that different types of arm supports have been developed to help stabilize the arms. The prior art is replete with different types of static supports that are used to support guns, bows, cameras and the like. Such static supports often come in the form of collapsible bipods or tripods. The main disadvantage of static supports is that they only support a gun, bow or camera when such objects are stationary. Such supports rest upon the ground. As such, such supports do not move with the arms as the arms move to track a target. To eliminate this disadvantage, supports have been developed that attach to the body and move in unison with the body as a gun, bow or camera is moved. Such prior art supports are exemplified by U.S. Pat. No. 759,593 to Cover, entitled Gunner's Arm Rest; U.S. Pat. No. 3,390,477 to Galbraith, entitled Supporting Device For Sighting Firearms; and U.S. Pat. No. 5,351,867 to Vest, entitled Arm Steady Brace.

In each of the prior art patents cited above, an arm rest is disclosed where a support extends upwardly from a person's hip. In each instance, the length of the support is set at affixed length. Accordingly, the support prevents the arm from moving downwardly. In many instances a person tracking a target with a gun, bow or camera must move his/her arm downwardly. In such situations, prior art arm supports would prevent a person from properly tracking the target. Additionally, in the cited prior art, the arm support extends from the body at a predetermined angle. If a person were to take his/her arm off of the support, the support then becomes an obstacle that restricts the movement of the arms of that person.

A need therefore exists for an arm support device that can be used to support an arm and prevent inadvertent movement, yet does not restrict desired movements of the arm. A need also exists for an arm support device that does not interfere with movements of the arms when not in use. These needs are met by the present invention as described and claimed below.

SUMMARY OF THE INVENTION

The present invention is a support device for supporting a person's arm when the arm is extended. The device can also be used to support an optical instrument such as a camera. The support device has a base structure adapted to be worn about a person's waist, proximate the hip. A support shaft extends from the base structure. The support shaft has a predetermined extended length between a first end and a second end. The support shaft contains a piston between its two ends. The presence of the piston enables said support shaft to be contracted to a contracted length that is less than its normal length. This enables a person to move his/her arm up and down while still being supported. The support shaft connects to the base structure with a ball and socket joint. Consequently, the support shaft is also free to move back and forth with that person's arm.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
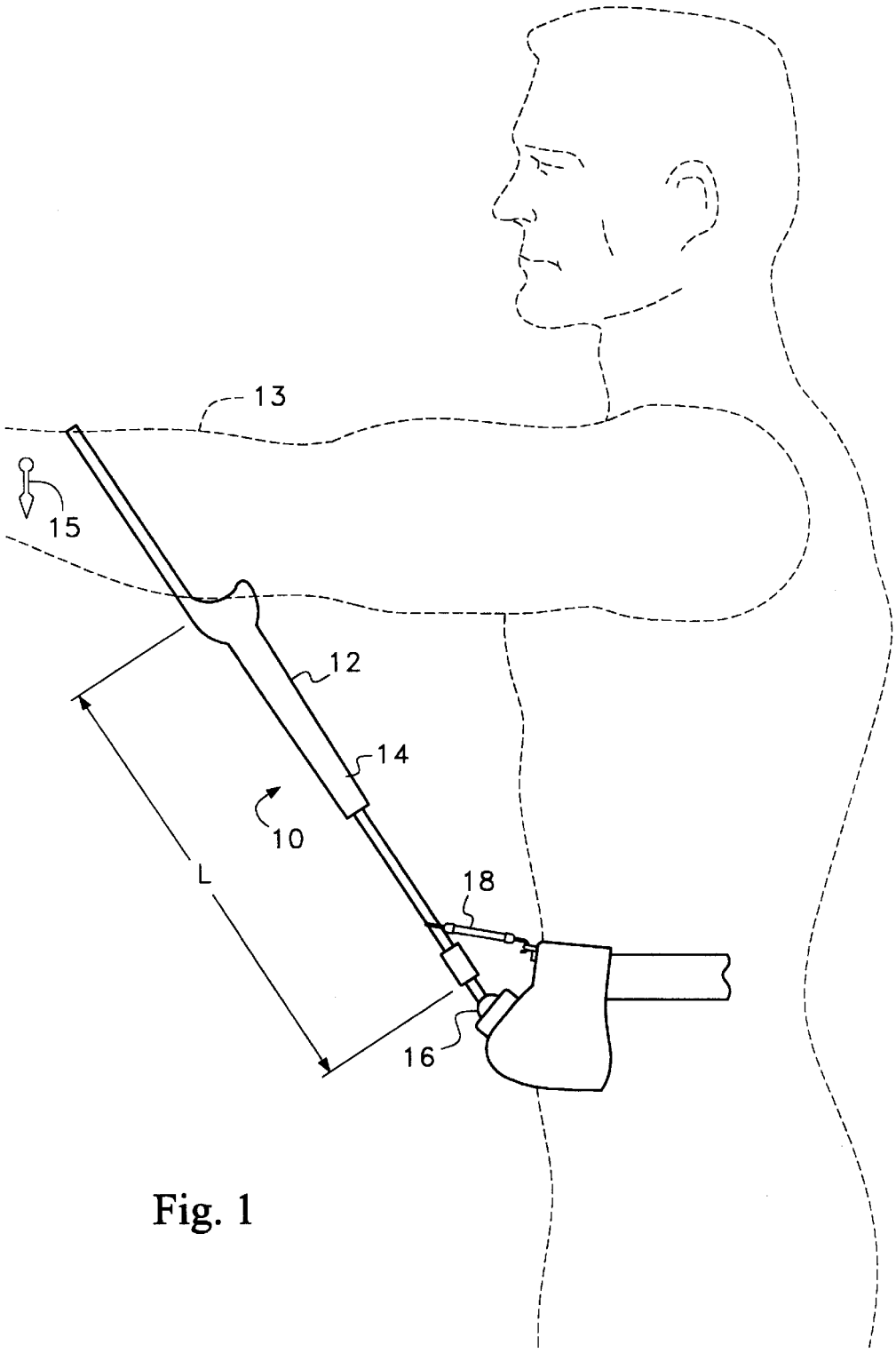
FIG. 1 is a side view of an exemplary arm support in accordance with the present invention. The arm support is shown in use supporting an arm.

Referring to FIG. 1, an exemplary arm support device 10 in accordance with the present invention is shown. In this embodiment, the arm support device 10 is a structure that is connected to a person's body around the waste. A shaft 12 extends from the point of the hip and supports the arm 13 at some position between the shoulder and the elbow.

The arm support device 10 embodies features that represent an improvement in the art. The first of these features is the shaft 12 itself. The shaft 12 has a length L. However, the shaft 12 embodies a piston 14 that enables the shaft 12 to be compressed to a length significantly shorter that the original length L. As a result, when a person moves their arm downwardly in the direction of arrow 15, the shaft will compress, provided the compression force surpasses a predetermined threshold value. As the shaft 12 is compressed, the shaft 12 continues to support the arm 13. Accordingly, the arm support device 10 does not prevent a person from moving his/her supported arm 13 in a downwardly direction.

A second improvement embodied by the arm support device 10 is the use of a ball and socket joint 16 at the base of the shaft 12. The ball and socket joints 16 enables the shaft 12 to move in any direction about the point of attachment. Accordingly, once a person's arm is supported by the device 10, the device 10 will not inhibit the range of movement for that arm.

Bias elements 18 engage the shaft 12 and biases the shaft 12 toward the body. Accordingly, when a person removes his/her arm 13 from the arm support device 10, the shaft 12 of the device 10 automatically moves up against the body.

Figure 2:
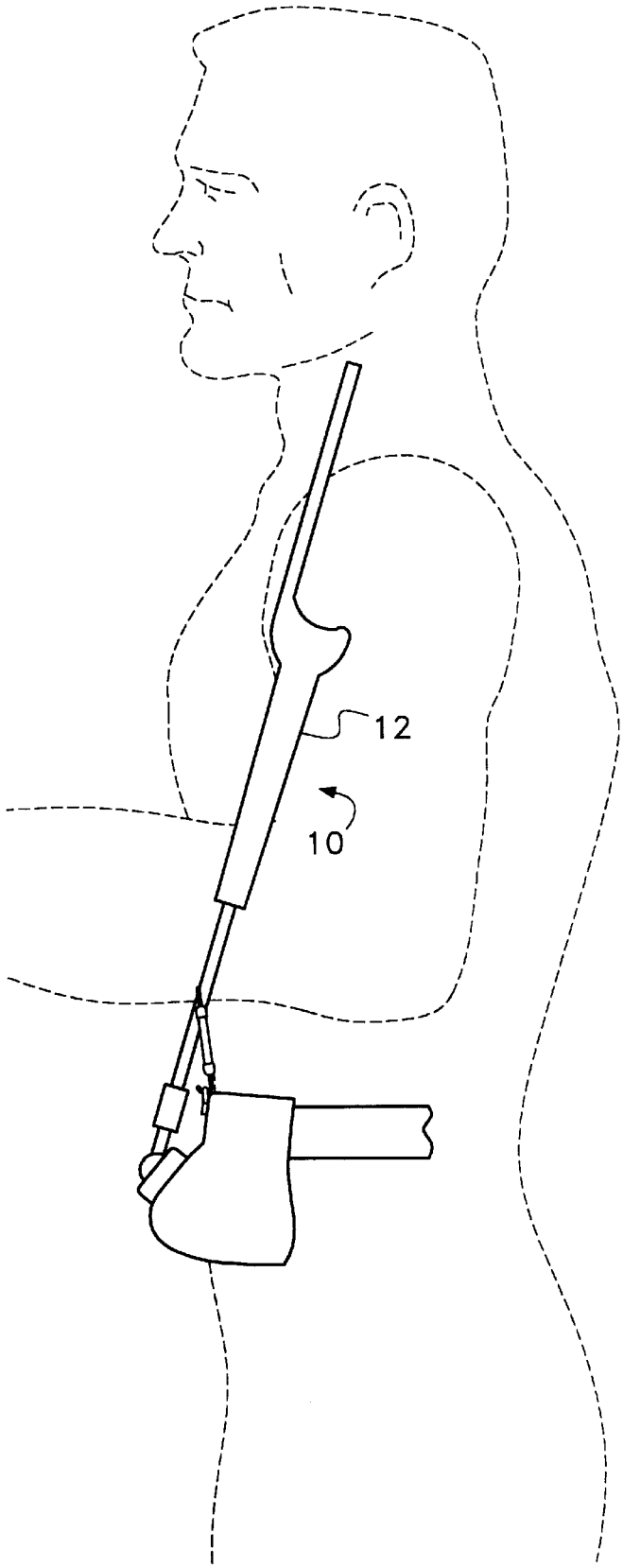
FIG. 2 is a side view of the embodiment of the arm support shown in FIG. 1, wherein the arm support is shown in a stowed position.

Referring to FIG. 2, it can be seen that once the shaft 12 is oriented against the body, the shaft 12 can be positioned behind the shoulder and arm. In this position, the arm support device 10 does not obstruct the arms or anything else in the front of the body.

Yet another advantage of the arm support device 10 is that the shaft 12 is detachable. This enables shafts that terminate with different configurations to be interchangeably used within the device 10. Examples of different types of shafts will later be explained.

Figure 3:
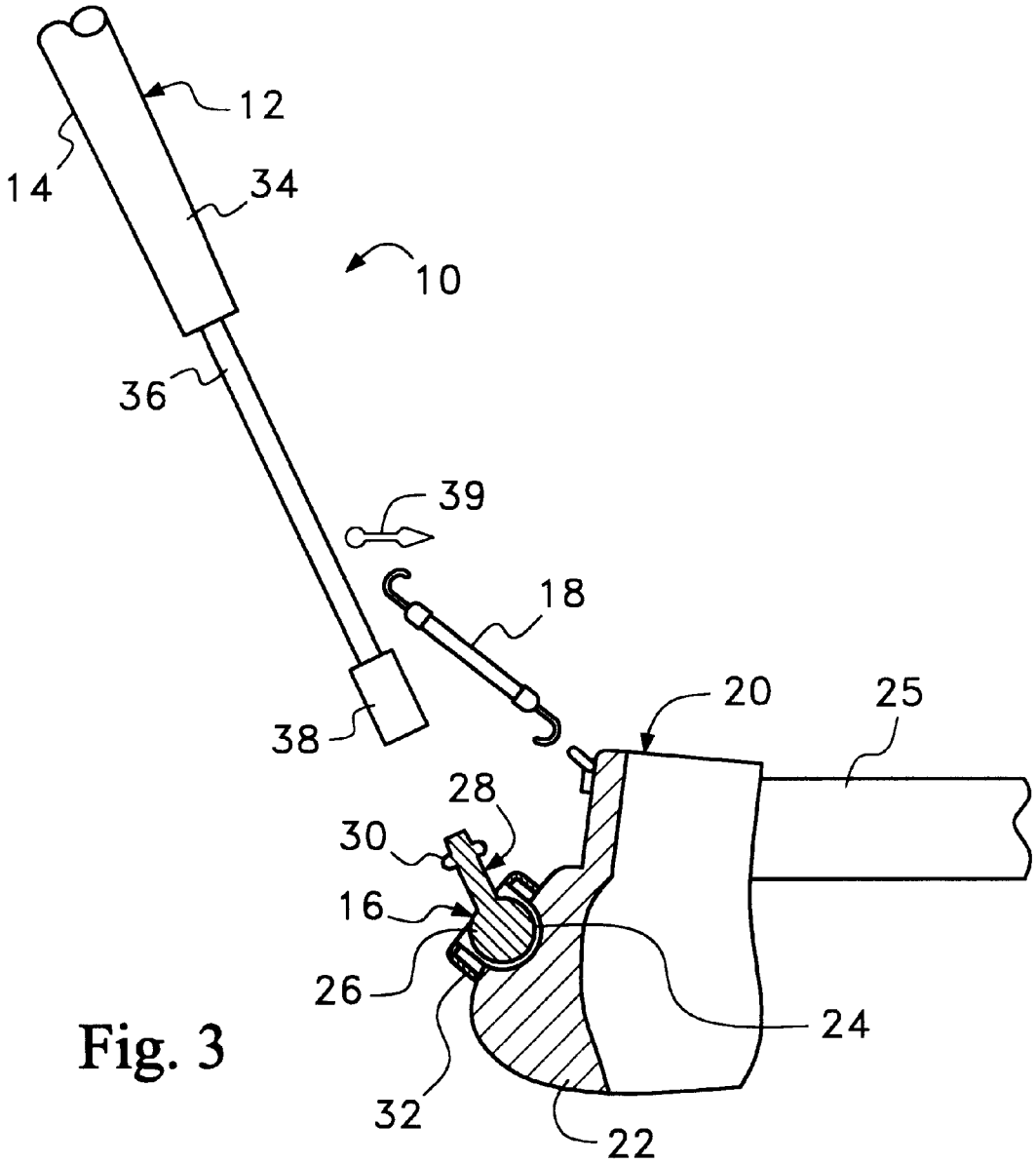
FIG. 3 is a cross-sectional view of the base structure of the arm support shown in FIG. 1. The cross-sectional view is shown in conjunction with a segment of the a support shaft to illustrate the interconnection of these elements.

Referring to FIG. 3, a detailed view of a base support 20 is shown. The base support 20 is the segment of the arm support device 10 that attaches to the hip and supports the shaft 12. The base support 20 contains a structure 22 that is contoured to rest against hip protrusion of an individual. The structure 22 is held in place against the hip by a belt 25, or similar strapping, that attaches to the structure 22 and passes around the waist. As the belt 25 is tightened, the belt 25 biases the base structure 22 against the hip, thereby retaining the base structure 22 in place over the hip.

A socket relief 24 is formed in the center of the exterior of the base structure 22. The socket relief 24 is sized to receive a ball, thereby forming a ball and socket joint 16. In the shown embodiment, the ball 26 is disposed at one end of a attachment element 28. The attachment element 28 contains an elongated stem. At one end of the elongated stem is disposed the ball 26. At the other end of the stem is disposed a nipple connection 30. A collar 32 passes over the attachment element 28 and retains the ball 26 in place within the socket relief 24. The ball 26 is free to rotate within the confines of the socket relief 24. Accordingly, the attachment element 28 is free to pivot in any direction about the center of the ball 26.

In FIG. 3, a segment of the support shaft 12 is also shown. The support shaft 12 contains a telescoping piston 14 that contains a piston housing 34 and a piston arm 36. The piston 14 can be a pneumatic piston, a spring piston or a hydraulic piston. Regardless of the type of piston, the telescoping piston 14 is biased into a predetermined length. When a compression force is applied to the piston 14 that is in excess of its internal bias force, the piston arm 36 will retract into the piston housing 34 and the overall length of the piston 14 will decrease. The internal bias of the piston 14 should be sufficient enough to support the weight of the arm, when the arm is at rest. However, the piston 14 should compress when a person asserts an intentional downward movement to their arm. To fit this criteria, it is preferred that the piston 14 contain an internal bias compression threshold of between four and ten pounds.

The bottom of the support shaft 12 terminates with a quick connect connector 38. The quick connect connector 38 is adapted to selectively receive and engage the nipple connector 30 on the attachment element 28. As a result, the support shaft 12 can be rapidly connected to, or disconnected from, the attachment element 28. When attached, the exemplary use of a quick connect connector 38 enable the support shaft 12 to freely rotate about its longitudinal axis without effecting the strength of the connection. This adds another degree of adjustability to the support shaft 12.

In FIG. 3 it can seen that biasing elements 18 are used to interconnect the base structure 22 to the support shaft 12. The biasing elements 18 can be springs, elastic bands, Bungee™ cords or the like. The biasing elements 18 are oriented and sized so that a bias is applied to the support shaft 12 in the direction of arrow 39. The bias acts to orient the support shaft 12 into a position close to vertical.

Figure 4:
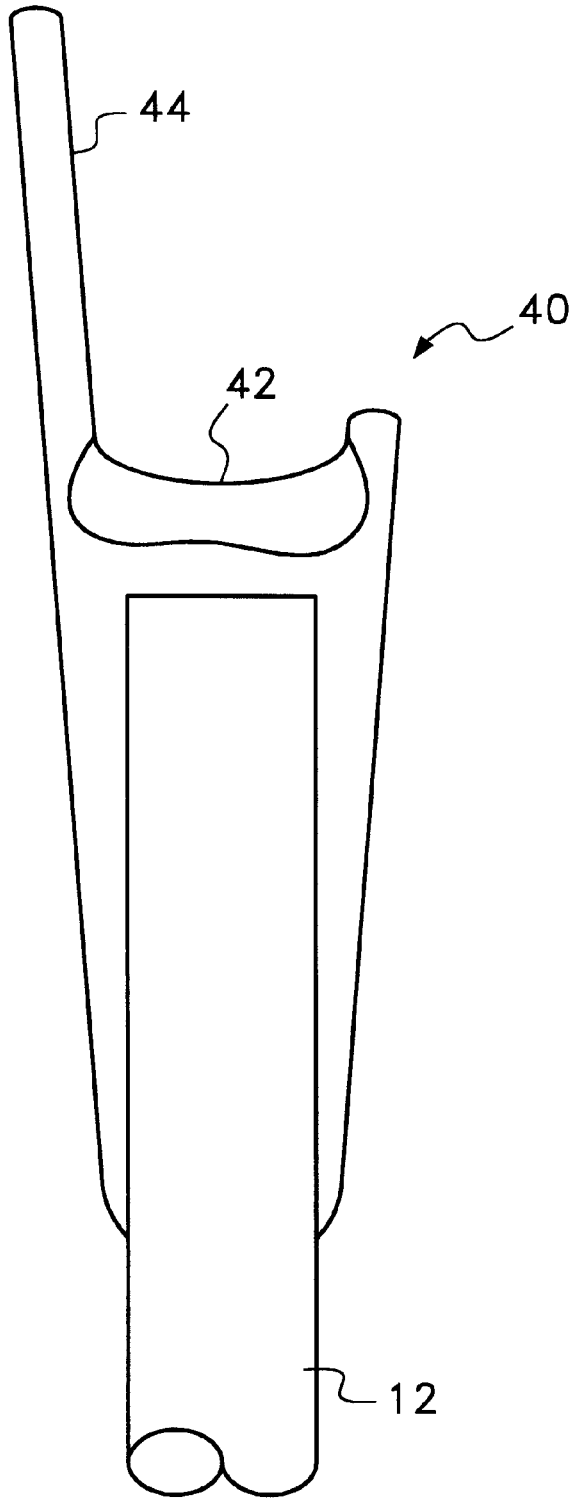
FIG. 4 is a front view of the top section of an support shaft.

Referring to FIG. 4, the top segment 40 of a first exemplary support shaft 12 is shown. In this embodiment, the top of the support shaft 12 terminates with a padded, generally L-shaped configuration. That foot 42 of the L-shaped configuration is the surface upon which a person rests his/her arm. The arm 44 of the L-shaped configuration prevents a person's arm from sliding off of the support. Many variations of the shown embodiment can also be used. For example U-shaped terminations or half cylindrical configuration can also be used to support a segment of the arm if desired.

Figure 5:
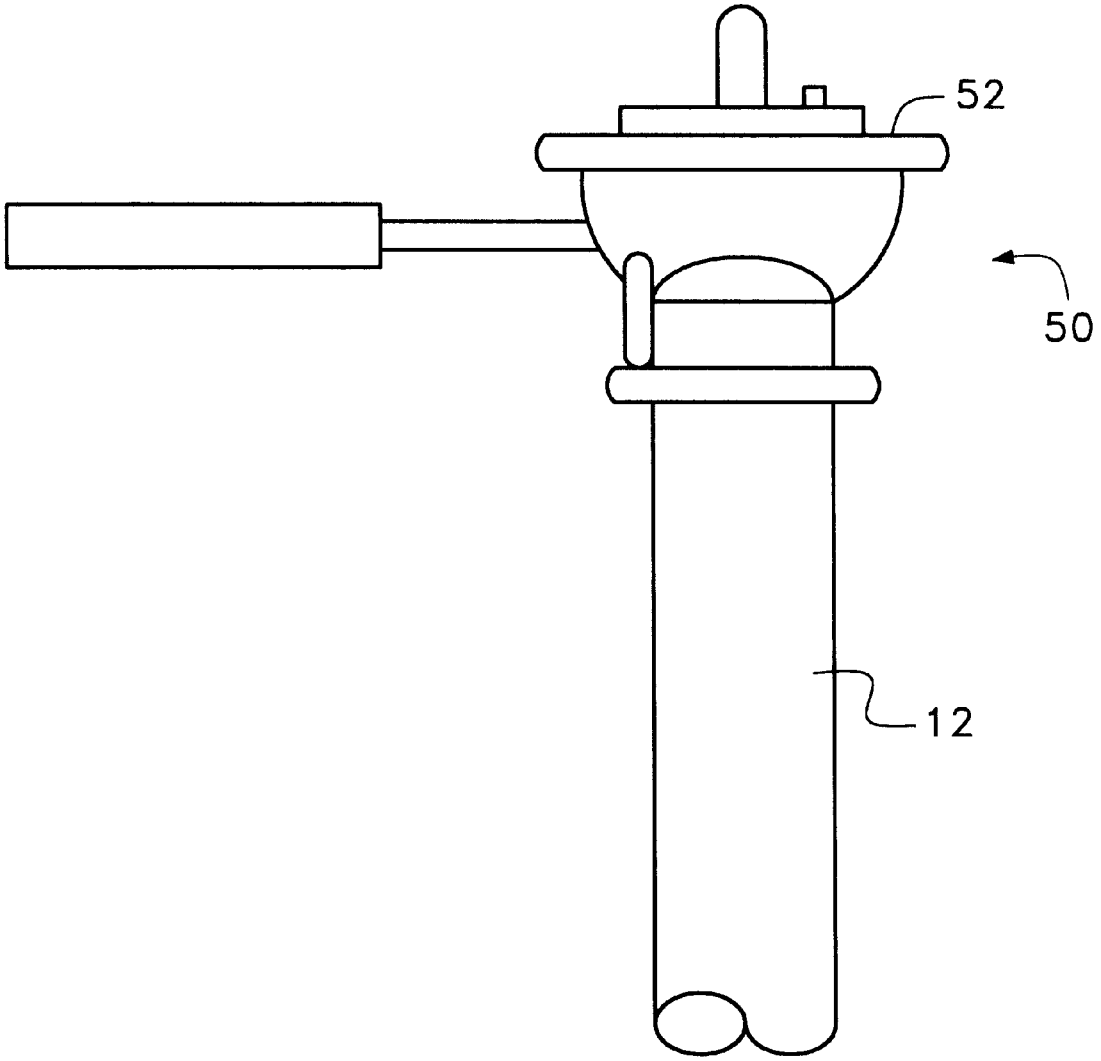
FIG. 5 is a front view of an alternate embodiment of the top section of a support shaft.

Referring to FIG. 5, an alternate embodiment of the top segment 50 of a support shaft 12 is shown. In this embodiment, a camera leveling assembly 52 is affixed to the top of the support shaft 12. Numerous camera leveling devices are known and used in the art. Any such camera leveling device can be adapted for use in the present invention. The camera leveling device provides a platform that can engage either a still frame camera, a video camera, binoculars, a spotting scope or other optical instrument. Consequently, the present invention support device can be used to directly support a camera in place of a person's arm.

Since different support shafts are interchangeable on the present invention, a person can selectively change the support shaft as needed. For instance, a hunter can attach one support shaft to support a pair of binoculars while searching for a target. The hunter can then change to the arm support shaft as a target moves closer and he hunter is to attempt a shot.

It will be understood that a person skilled in the art could make alternate embodiments of the present invention using functionally equivalent components that have not been specifically described. For example, many different types of mechanical connectors can be used to selectively connect the support shaft to the base structure. Furthermore, it should be understood that the features shown in the various described embodiments can be interchanged to produce yet additional embodiments. All such modifications are intended to be included in the scope of this disclosure as defined by the appended claims.

What is claimed is:

1. A support device, comprising:

a base structure adapted to be worn about the waist proximate a person's hip;

a support shaft having a predetermined extended length between a first end and a second end, said support shaft containing a piston between said first end and said second end that enables said support shaft to be contracted to a contracted length that is less than said predetermined extended length, wherein said second end of said support shaft is coupled to said base structure and said support shaft extends away from said base structure;

at least one biasing element extending between said base structure and said support shaft, said at least one biasing element applying a biasing force to said support shaft that pulls said support shaft toward a generally vertical orientation above said base structure, wherein said at least one biasing element is selected from a group consisting of springs, elastic bands and elastic cords.

2. The device according to claim 1, wherein said first end of said support arm terminates with an arm support.

3. The device according to claim 1, wherein said first end of said support arm terminates with an optical device mount.

4. The device according to claim 1, wherein said piston begins to compress when a predetermined compression force is experience between said first end and said second end, said predetermined compression force being between four pounds and ten pounds.

5. The device according to claim 1, wherein a ball and socket joint exists between said support shaft and said base structure.

6. The device according to claim 1, further including an attachment element coupled to said base structure, wherein said second end of said support shaft selectively attaches to said attachment element.

7. The device according to claim 5, wherein said attachment device is coupled to said base structure with a ball and socket joint.

8. The device according to claim 5, wherein a first connector is disposed at said second end of said support shaft and a second connector is disposed on said attachment device that is adapted to selectively interconnect with said first connector.

9. The device according to claim 1, wherein said support shaft has a longitudinal axis and said support shaft is free to rotate around said longitudinal axis when connected to said base structure.

10. The device according to claim 1, wherein said base structure is configured to conform to the hip of the person wearing the base structure.

11. The device according to claim 1, wherein said base structure includes a belt for wearing said base structure around a person's waist.

12. An arm support device, comprising:

a base structure;

a belt for attaching said base structure around the waist of a person;

an arm support;

a support shaft extending between said base structure and said arm support; and at least one biasing element extending between said base structure and said support shaft, said at least one biasing element applying a biasing force to said support shaft that pulls said support shaft toward a generally vertical orientation above said base structure, wherein said at least one biasing element is selected from a group consisting of springs, elastic bands and elastic cords.

13. The device according to claim 11, wherein said support shaft contains a piston mechanism than enables said support shaft to be compressed in length.

14. The device according to claim 11, wherein said support shaft has a longitudinal axis and said support shaft is free to rotate about said longitudinal axis.

15. The device according to claim 11, wherein a ball and socket joint exists between said support shaft and said base structure.

* * * * *